US008077120B2

(12) United States Patent
Yoshihama

(10) Patent No.: US 8,077,120 B2
(45) Date of Patent: Dec. 13, 2011

(54) PLASMA DISPLAY PANEL DRIVING METHOD AND PLASMA DISPLAY DEVICE

(75) Inventor: Yutaka Yoshihama, Osaka (JP)

(73) Assignee: Panasonic Corporation, Osaka (JP)

( * ) Notice: Subject to any disclaimer, the term of this patent is extended or adjusted under 35 U.S.C. 154(b) by 755 days.

(21) Appl. No.: 12/161,624

(22) PCT Filed: Nov. 7, 2007

(86) PCT No.: PCT/JP2007/071601

§ 371 (c)(1),
(2), (4) Date: Jul. 21, 2008

(87) PCT Pub. No.: WO2008/059735

PCT Pub. Date: May 22, 2008

(65) Prior Publication Data

US 2009/0167640 A1 Jul. 2, 2009

(30) Foreign Application Priority Data

Nov. 15, 2006 (JP) ..... 2006-308763

(51) Int. Cl.
*G09G 3/28* (2006.01)

(52) U.S. Cl. ..... 345/60; 345/63; 345/66

(58) Field of Classification Search ..... 345/60–63
See application file for complete search history.

(56) References Cited

U.S. PATENT DOCUMENTS

| | | | | |
|---|---|---|---|---|
| 7,710,354 | B2 * | 5/2010 | Yoo | 345/60 |
| 2003/0080928 | A1 | 5/2003 | Shoji et al. | |
| 2003/0234753 | A1 | 12/2003 | Tanaka | |
| 2005/0162348 | A1 * | 7/2005 | Ogawa et al. | 345/63 |
| 2005/0231444 | A1 * | 10/2005 | Takeuchi et al. | 345/63 |
| 2005/0248504 | A1 * | 11/2005 | Kim et al. | 345/60 |
| 2006/0214885 | A1 * | 9/2006 | Jung et al. | 345/63 |
| 2006/0279479 | A1 * | 12/2006 | Jung et al. | 345/60 |
| 2007/0097027 | A1 * | 5/2007 | Moon | 345/60 |
| 2007/0132666 | A1 * | 6/2007 | Lee | 345/60 |
| 2008/0012795 | A1 * | 1/2008 | Shim et al. | 345/60 |

FOREIGN PATENT DOCUMENTS

| | | | |
|---|---|---|---|
| JP | 11-231825 | A | 8/1999 |
| JP | 2000-242224 | A | 9/2000 |
| JP | 2002-366084 | A | 12/2002 |

(Continued)

OTHER PUBLICATIONS

Japanese language International Search Report for PCT/JP2007/071601, dated Nov. 15, 2006.

(Continued)

*Primary Examiner* — Amare Mengistu
*Assistant Examiner* — Premal Patel
(74) *Attorney, Agent, or Firm* — RatnerPrestia

(57) ABSTRACT

A plasma display panel driving method and a plasma display device capable of reducing initializing spots generated immediately after the start of driving the plasma display panel, and improving the quality of images to be displayed. A plurality of subfields, each including an initializing period, an address period, and a sustain period, are provided in one field. The one field includes at least one of the subfields in which a gently increasing ramp waveform voltage is applied to the scan electrodes in the initializing period thereof. The ramp waveform voltage to be applied to the scan electrodes for the first time after the start of driving the plasma display panel is generated so as to have a gentler slope than the other ramp waveform voltages have.

10 Claims, 8 Drawing Sheets

FOREIGN PATENT DOCUMENTS

| | | | |
|---|---|---|---|
| JP | 2003-337567 | A | 11/2003 |
| JP | 2005-234372 | A | 9/2005 |
| JP | 2006-178441 | A | 7/2006 |

OTHER PUBLICATIONS

Supplementary European Search Report for Application No. EP 07 83 1332, Oct. 28, 2010, Panasonic Corporation.

K. Sakita et al., "10.3 Analysis of a Weak Discharge of Ramp-Wave Driving to Control Wall Voltage and Luminance in AC-PDPs", 2000 SID International Symposium—May 16-18, 2000, Long Beach, California, vol. XXXI, May 16, 2000, p. 110, XP007007340, p. 110, col. 2, line 9—p. 111, col. 1, line 17; figures 1(b), 3.

Office Action for 07 831 332.7-2205, May 30, 2011.

* cited by examiner

PLASMA DISPLAY PANEL DRIVING METHOD AND PLASMA DISPLAY DEVICE

This application is a U.S. National Phase application of PCT International application PCT/JP2007/071601.

TECHNICAL FIELD

The present invention relates to a method of driving a plasma display panel for use in a wall-mounted television or a large monitor, and to a plasma display device.

BACKGROUND ART

An alternating-current surface-discharge panel representative of a plasma display panel (hereinafter abbreviated as "panel") has a large number of discharge cells formed between the front plate and the rear plate faced to each other. For the front plate, a plurality of display electrode pairs, each made of a scan electrode and a sustain electrode, are formed on a front glass substrate in parallel with each other. A dielectric layer and a protective layer are formed to cover these display electrode pairs. For the rear plate, a plurality of parallel data electrodes are formed on a rear glass substrate and a dielectric layer is formed over the data electrodes to cover them. Further, a plurality of barrier ribs are formed on the dielectric layer in parallel with the data electrodes. Phosphor layers are formed over the surface of the dielectric layer and the side faces of the barrier ribs. Then, the front plate and the rear plate are faced to each other and sealed together so that the display electrode pairs are intersected with the data electrodes. A discharge gas containing xenon in a partial pressure ratio of 5%, for example, is charged into the inside discharge space formed between the plates. Discharge cells are formed in portions where the respective display electrode pairs are faced to the corresponding data electrodes. For a panel structured as above, gas discharge generates ultraviolet light in each discharge cell. This ultraviolet light excites the red (R), green (G), and blue (G) phosphors so that the phosphors emit the respective colors for color display.

A general method of driving a panel is a subfield method: one field is divided into a plurality of subfields and combinations of light-emitting subfields provide gradation display.

Each subfield has an initializing period, an address period, and a sustain period. In the initializing period, initializing discharge is caused so that wall charge necessary for the succeeding address operation is formed on the respective electrodes and priming particles (excited particles to work as priming for discharge) are generated to stabilize the address discharge.

In the address period, application of address pulse voltage selectively to the discharge cells to be lit causes address discharge and forms wall charge (hereinafter this operation also being referred to as "addressing"). In the sustain period, sustain pulses are applied alternately to the display electrode pairs, each made of a scan electrode and a sustain electrode. This application causes sustain discharge in the discharge cells having generated the address discharge, and causes the phosphor layers of the corresponding discharge cells to emit light. Thus, an image is displayed.

Further, a novel driving method is disclosed among the subfield methods. In this driving method, initializing discharge is caused by using a gently changing voltage waveform, and initializing discharge is further performed selectively on the discharge cells having generated sustain discharge. Thus, light emission unrelated to gradation display is minimized and the contrast ratio is improved.

Specifically, among a plurality of subfields, in the initializing period of one subfield, an initializing operation for causing initializing discharge in all the discharge cells (hereinafter abbreviated as "all-cell initializing operation") is performed. In the initializing period of each of the other subfields, an initializing operation for causing initializing discharge only in the discharge cells having generated sustain discharge (hereinafter "selective initializing operation") is performed. In this driving method, the light emission unrelated to image display is only the light emission caused by the discharge in the all-cell initializing operation and thus the luminance of the areas displaying black pictures (hereinafter "black picture level") is only due to the weak light emission in the all-cell initializing operation. Thus, images having a high contrast can be displayed. (See Patent Document 1, for example.)

Further, the above Patent Document 1 includes the description of so-called erasing discharge using a narrow pulse. In this erasing discharge, the pulse width of the last sustain pulse in the sustain period is set shorter than the pulse widths of the other sustain pulses so that the potential difference between the display electrode pairs caused by the wall charge thereon is alleviated. Generating this erasing discharge using a narrow pulse can ensure the address operation in the address period of the succeeding subfield and provide a plasma display device having a high contrast ratio.

Further, techniques are proposed to control the luminance of an image to be displayed and thus to improve the visibility of the image. One of such techniques is to detect the average picture level (hereinafter "APL") of input image signals and to control the number of sustain pulses in the sustain period according to the APL. (See Patent Document 2, for example.)

The number of sustain pulses in each subfield is determined by multiplying a ratio of the brightness to be displayed (hereinafter "brightness weight") in the subfield by a proportionality factor (hereinafter "luminance factor"). In this technique, the luminance factor is controlled according to the APL, and thereby the number of sustain pulses in each subfield is determined. Control is made so that the luminance factor is lower for an image signal having a higher APL, and the luminance factor is higher for an image signal providing a dark image and having a lower APL. Such control can increase the luminance of the image to be displayed and make the dark image brighter, and thus provides a more visible image, when the APL is lower.

Immediately after a plasma display device is powered on, the operation of each circuit, such as an image signal processing circuit, power supply circuit, and driving circuit, is not stable and thus an abnormal image can be displayed in the plasma display device. A general method of addressing this problem is to stop the address operation and display a black picture on the entire display surface (hereinafter "image muting") for a few seconds immediately after the power-on until the stabilized operation of each circuit.

On the other hand, in the panel of a plasma display device immediately after the driving has been initiated by the power-on, insufficient priming particles can induce strong discharge in the initializing operation. This strong discharge can cause some discharge cells to generate sustain discharge and emit light even though address operation is not performed therein (hereinafter referred to as "initializing spot").

Particularly in the muting period, a black picture is shown on the entire image display surface of the panel. Thus, the initializing spots are easy to recognize and the quality of displayed images seems to deteriorate.

[Patent Document 1] Japanese Patent Unexamined Publication No.

[Patent Document 2] Japanese Patent Unexamined Publication No. H11-231825

SUMMARY OF THE INVENTION

A plasma display panel driving method is a method of driving a panel including a plurality of discharge cells. Each discharge cell includes a display electrode pair and a data electrode. Each display electrode pair includes a scan electrode and a sustain electrode. A plurality of subfields, each including an initializing period, an address period, and a sustain period, are provided in one field. The one field includes at least one of the subfields in which a gently increasing ramp waveform voltage is applied to the scan electrodes in the initializing period thereof. The ramp waveform voltage to be applied to the scan electrodes for the first time after start of driving the panel is generated so as to have a gentler slope than the other ramp waveform voltages have.

This method can reduce initializing spots generated immediately after the start of driving the panel, and improve the quality of images to be displayed.

REFERENCE MARKS IN THE DRAWINGS

Figure 1:
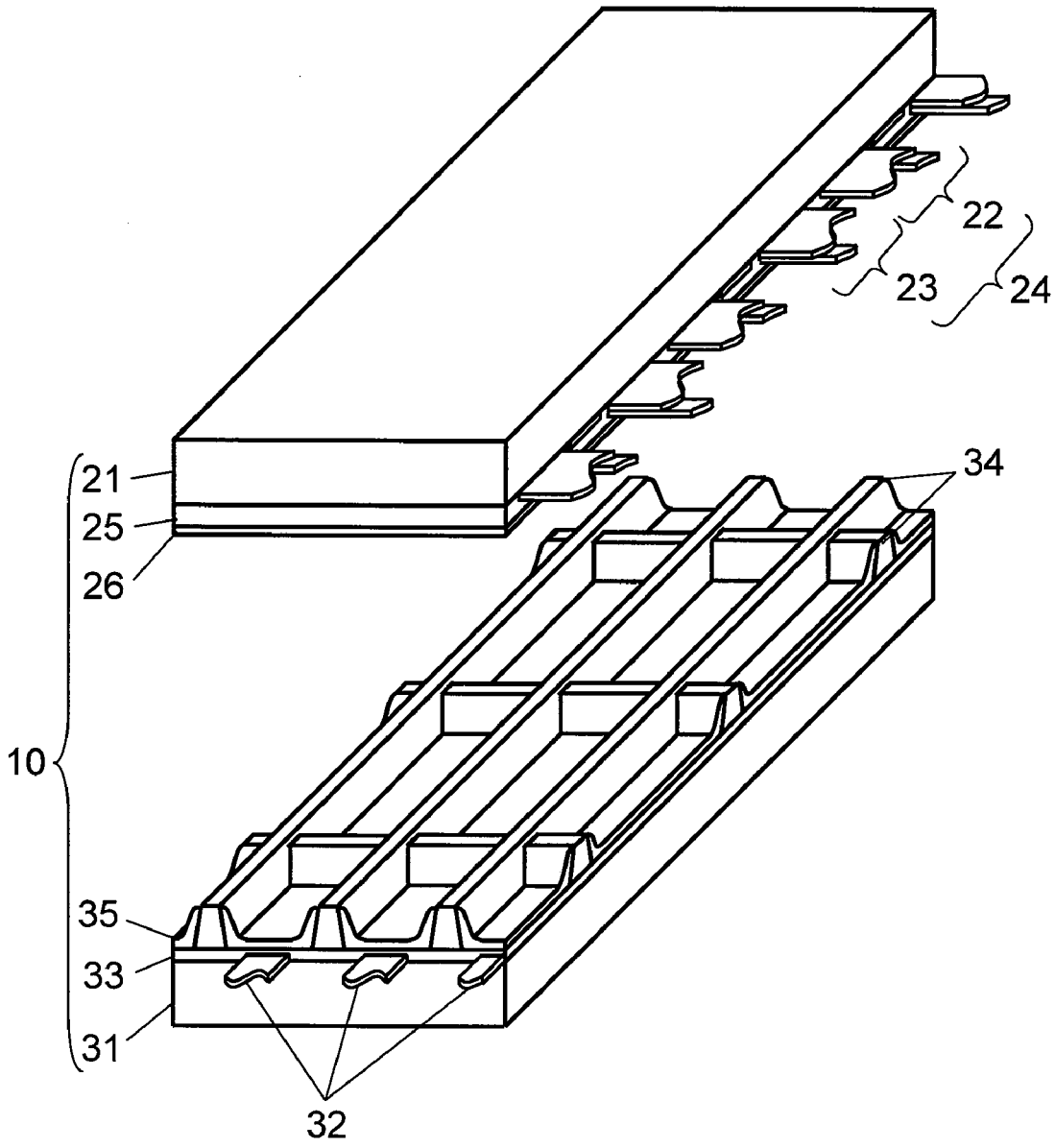
FIG. 1 is an exploded perspective view showing a structure of a panel in accordance with an exemplary embodiment of the present invention.

1 Plasma display device
10 Panel
21 (Glass) front plate
22 Scan electrode
23 Sustain electrode
24 Display electrode pair
25, 33 Dielectric layer
26 Protective layer
31 Rear plate
32 Data electrode
34 Barrier rib
35 Phosphor layer
51 Image signal processing circuit
52 Data electrode driving circuit
53 Scan electrode driving circuit
54 Sustain electrode driving circuit
55 Timing generating circuit
56 APL detecting circuit
60 Power supply circuit
62 Main power supply switch
63 Driving power supply
64 Standby power supply
65 Conduction detector
70 Control circuit
72 Remote control controller
73 Remote control photoreceptor
76 Power supply controller
78 ON-OFF controller
80 Remote control
81 Sustain pulse generating circuit
82 Initializing waveform generating circuit
83 Scan pulse generating circuit
84 Power recovery circuit
85 Clamp circuit
Q1, Q2, Q3, Q4, Q5, Q6, Q7, Q8, Q9, QH1 to QHn, QL1 to QLn Switching element
C1, C2, C3, C4, C5, C6 Capacitor
R1, R2 Resistor
INa, INb Input terminal
D1, D2, D3, D4 Diode
L1 Inductor

DETAILED DESCRIPTION OF PREFERRED EMBODIMENT

Hereinafter, a description is provided of a plasma display device in accordance with an exemplary embodiment of the present invention, with reference to the accompanying drawings.

Exemplary Embodiment

FIG. 1 is an exploded perspective view showing a structure of panel 10 in accordance with the exemplary embodiment of the present invention. A plurality of display electrode pairs 24, each including scan electrode 22 and sustain electrode 23, are formed on glass front plate 21. Dielectric layer 25 is formed to cover scan electrodes 22 and sustain electrodes 23. Protective layer 26 is formed over dielectric layer 25.

Protective layer 26 is made of a material predominantly composed of MgO to decrease breakdown voltage in the discharge cells. MgO has excellent results as a panel material, and exhibits a large secondary electron emission coefficient and an excellent durability when neon (Ne) and xenon (Xe) gas is charged.

A plurality of data electrodes 32 are formed on rear plate 31. Dielectric layer 33 is formed to cover data electrodes 32. On the dielectric layer, barrier ribs 34 are formed in a double cross shape. Further, over the side faces of barrier ribs 34 and dielectric layer 33, phosphor layers 35 for emitting red (R), green (G), or blue (B) light are provided.

These front plate 21 and rear plate 31 are faced to each other sandwiching a small discharge space therebetween so that display electrode pairs 24 are intersected with data electrodes 32. The outer peripheries of the plates are sealed with a sealing material, such as a glass frit. In the discharge space, a mixed gas of neon and xenon, for example, is charged as a discharge gas. The discharge space is partitioned into a plurality of compartments by barrier ribs 34. Discharge cells are formed at intersections between display electrode pairs 24 and data electrodes 32. Discharging and lighting in these discharge cells allows image display.

The structure of the panel is not limited to the above, and may include stripe-shaped barrier ribs.

Figure 2:
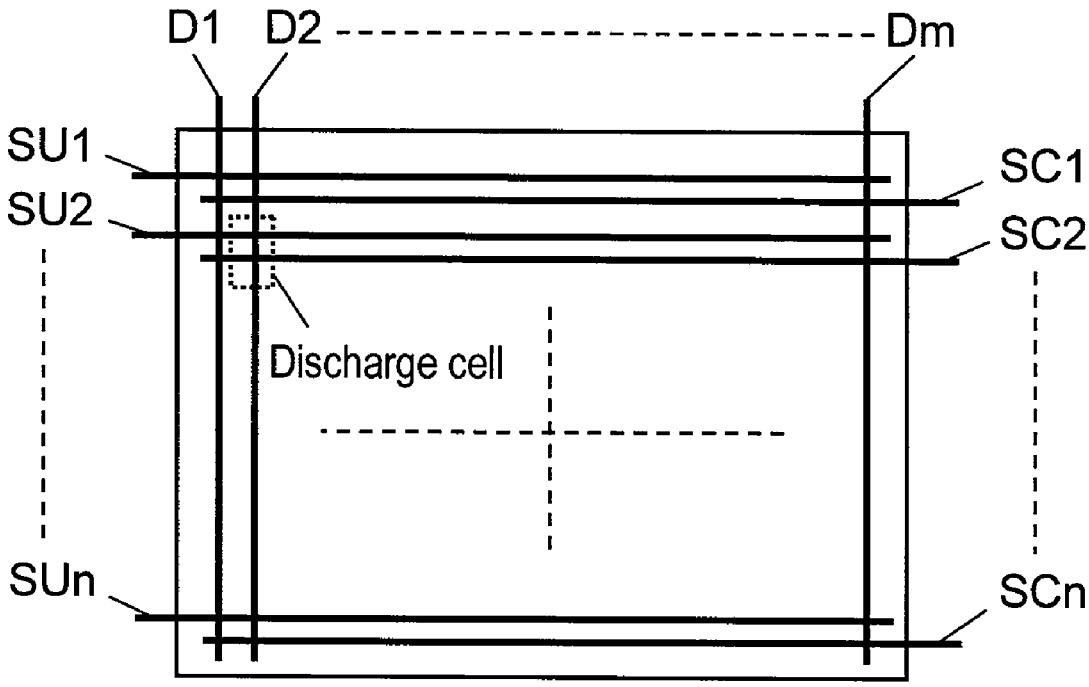
FIG. 2 is a diagram showing an array of electrodes of the panel.

FIG. 2 is a diagram showing an array of electrodes of panel 10 in accordance with the exemplary embodiment of the present invention. Panel 10 includes n scan electrodes SC1 to SCn (scan electrodes 22 of FIG. 1) and n sustain electrodes SU1 to SUn (sustain electrodes 23 of FIG. 1) both long in the row direction, and m data electrodes D1 to Dm (data electrodes 32 of FIG. 1) long in the column direction. A discharge cell is formed in a portion where a pair of scan electrode SCi (i=1 to n) and sustain electrode SUi are intersected with one data electrode Dj (j=1 to m). Thus, m×n discharge cells are formed in the discharge space. As shown in FIGS. 1 and 2, scan electrode SCi and sustain electrode SUi form a parallel pair. Thus, large inter-electrode capacitance Cp exists between scan electrodes SC1 to SCn and sustain electrodes SU1 to SUn, respectively.

Figure 3:
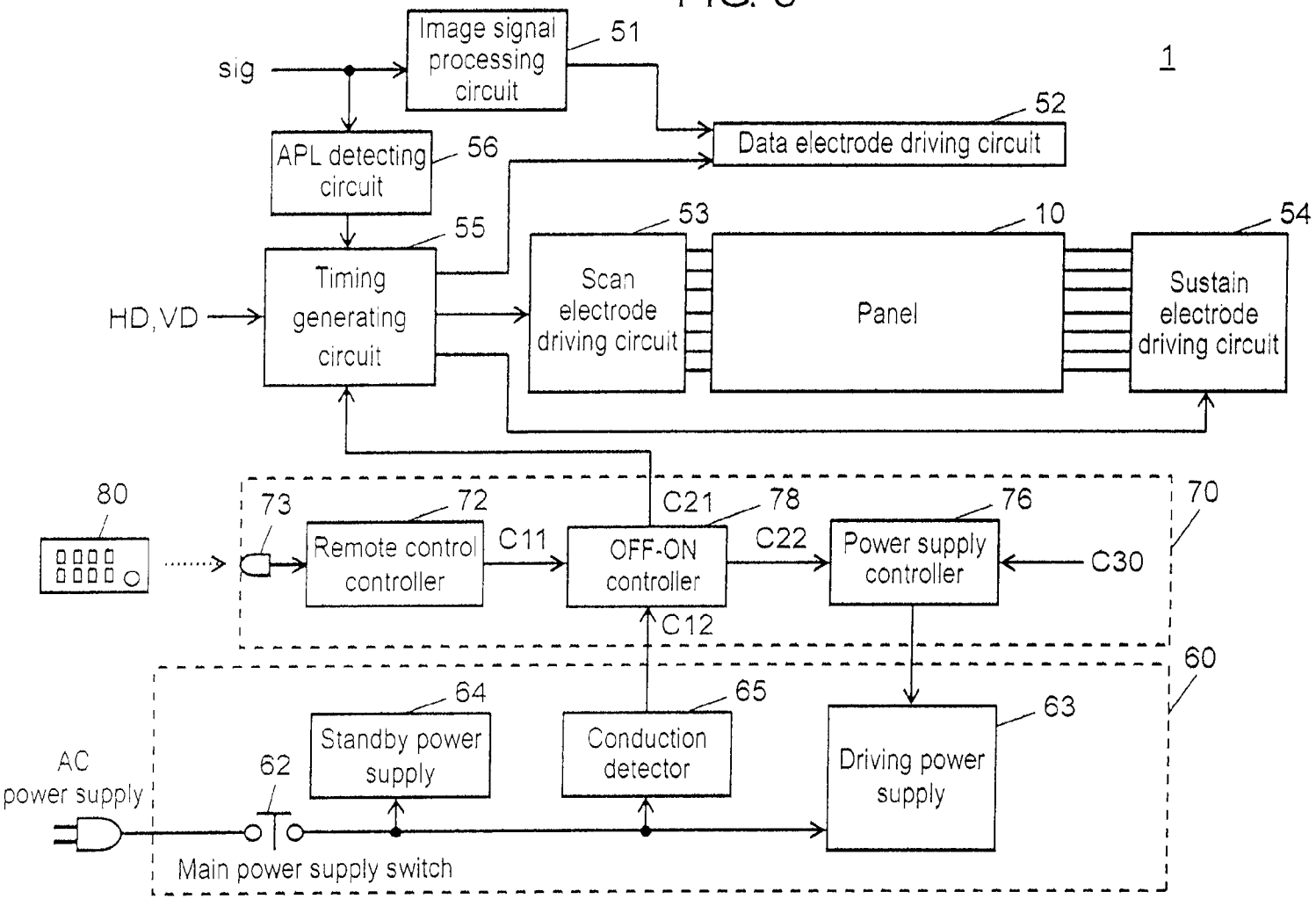
FIG. 3 is a diagram showing an example of circuit blocks of a plasma display device in accordance with the exemplary embodiment of the present invention.

FIG. 3 is a diagram showing an example of circuit blocks of the plasma display device in accordance with the exemplary embodiment of the present invention. With reference to FIG. 3, plasma display device 1 includes the following elements: panel 10 as described above; image signal processing circuit 51; data electrode driving circuit 52; scan electrode driving circuit 53; sustain electrode driving circuit 54; timing generating circuit 55; APL detecting circuit 56; power supply circuit 60; and control circuit 70.

Image signal processing circuit 51 converts supplied image signal sig into image data showing whether to light the discharge cells or not for each subfield.

APL detecting circuit 56 detects an APL, i.e. an average luminance level of image signal sig. Specifically, the APL is detected by a known technique, such as accumulating the luminance values of image signals over one field or one frame period. Other than using the luminance values, R signals, G signals, and B signals may be accumulated over one field and their averages may be obtained to provide an APL.

According to horizontal synchronizing signal HD, vertical synchronizing signal VD, detection results in APL detecting circuit 56, and output from ON-OFF controller 78 in control circuit 70, timing generating circuit 55 generates various kinds of timing signals for controlling the operation of each circuit block and supplies the timing signals to each circuit block.

Data electrode driving circuit 52 converts the image data for each subfield to signals corresponding to respective data electrodes D1 to Dm and drives respective data electrodes D1 to Dm, according to the timing signals from timing generating circuit 55. Scan electrode driving circuit 53 applies a drive voltage waveform to respective scan electrodes SC1 to SCn, according to the timing signals from timing generating circuit 55. Sustain electrode driving circuit 54 applies a drive voltage waveform to sustain electrodes SU1 to SUn, according to the timing signals from timing generating circuit 55.

Power supply circuit 60 includes the following elements: main power supply switch 62 for supplying power from a 100(V) commercial power supply to power supply circuit 60; driving power supply 63 for supplying power necessary for each circuit block that drives panel 10; standby power supply 64 for supplying power for operating control circuit 70; and conduction detector 65 for outputting a signal showing that main power supply switch 62 is turned on. Turning on main power supply switch 62 operates standby power supply 64 and conduction detector 65. On the other hand, whether to turn on or off driving power supply 63 is controlled by power supply controller 76 in control circuit 70. Though not shown, a drive voltage is supplied from driving power supply 63 to each of the above circuit blocks.

Control circuit 70 includes the following elements: remote control controller 72 that receives a signal from remote control switch (hereinafter abbreviated as "remote control") 80 and encodes the signal, using a microcomputer or the like; ON-OFF controller 78 for controlling whether to power on or off plasma display device 1 according to the output from conduction detector 65 and remote control controller 72; and power supply controller 76 for controlling whether to turn on or off driving power supply 63.

Remote control controller 72 receives the signal from remote control 80 at remote control photoreceptor 73, and generates ON signal C11 for controlling whether to power on or off plasma display device 1.

ON-OFF controller 78 generates enable signal C21 for controlling the operation of timing generating circuit 55, according to ON signal C11 that controls power-on and power-off in response to remote control 80 and according to main power supply ON signal C12 showing that main power supply switch 62 is turned on. As detailed later, according to enable signal C21, timing generating circuit 55 operates to reduce initializing spots for a predetermined period immediately after plasma display device 1 is powered on. (The plasma display device is determined to be powered on when both ON signal C11 and main power supply ON signal C12 are effected. This operation is also referred to as "power-on".) ON-OFF controller 78 generates enable signal C22 for controlling whether to turn on or off driving power supply 63, and outputs the signal to power supply controller 76.

Power supply controller 76 controls whether to turn on or off driving power supply 63, according to enable signal C22. Further, power supply controller 76 turns off driving power supply 63 when an abnormality occurs in plasma display device 1, according to emergency shutdown signal C30 showing the occurrence of abnormality.

Next, a description is provided of drive voltage waveforms for driving panel 10 and the operation thereof. A plasma display device of this exemplary embodiment provides gradation display by the subfield method: one field is divided into a plurality of subfields and whether to light the respective discharge cells or not is controlled for each of the subfields so that gradation display is provided. Each subfield has an initializing period, an address period, and a sustain period.

In the initializing period, initializing discharge is caused in the discharge cells to form wall charge necessary for the succeeding address operation. Further, priming particles (excited particles, i.e. priming for discharge) are generated to reduce the discharge delay and cause stable address discharge. At this time, the following two kinds of initializing operations are performed. One is an all-cell initializing operation for causing initializing discharge in all the discharge cells (an initializing period in which the all-cell initializing operation is performed hereinafter being referred to as "all-cell initializing period"). The other is a selective initializing operation for causing initializing discharge in the discharge cells having generated sustain discharge in the preceding subfield (an initializing period in which the selective initializing operation is performed hereinafter being referred to as "selective initializing period").

In the address period, in order to select the discharge cells to be lit in the succeeding sustain period, address discharge is selectively generated and wall charge is formed in the discharge cells. In the sustain period, a predetermined number of sustain pulses corresponding to the display brightness to be provided are applied to scan electrodes SC1 to SCn and sustain electrodes SU1 to SUn. This application causes discharge and light emission selectively in the discharge cells in which the address discharge has formed wall charge. The number of sustain pulses to be generated at this time is proportional to the brightness weight predetermined for each subfield. The proportionality factor is called "luminance factor".

In this exemplary embodiment, driving of panel 10 is initiated by starting the operation of timing generating circuit 55 according to enable signal C21 supplied from ON-OFF controller 78. The drive voltage waveform in the all-cell initializing operation to be performed for the first time after the start of driving panel 10 is different from the drive voltage waveform in the other all-cell initializing operations. Specifically, in the all-cell initializing operation to be performed for the first time after the start of driving panel 10, the increasing ramp waveform voltage to be applied to scan electrodes SC1 to SCn is generated so as to have a gentler slope than the ramp waveform voltage in the other all-cell initializing operations. This structure reduces the initializing spots generated immediately after the start of driving panel 10. Hereinafter, first, a description is provided of a normal drive voltage waveform. Next, a description is provided of the drive voltage waveform in the all-cell initializing operation to be performed for the first time after the start of driving panel 10.

Figure 4:
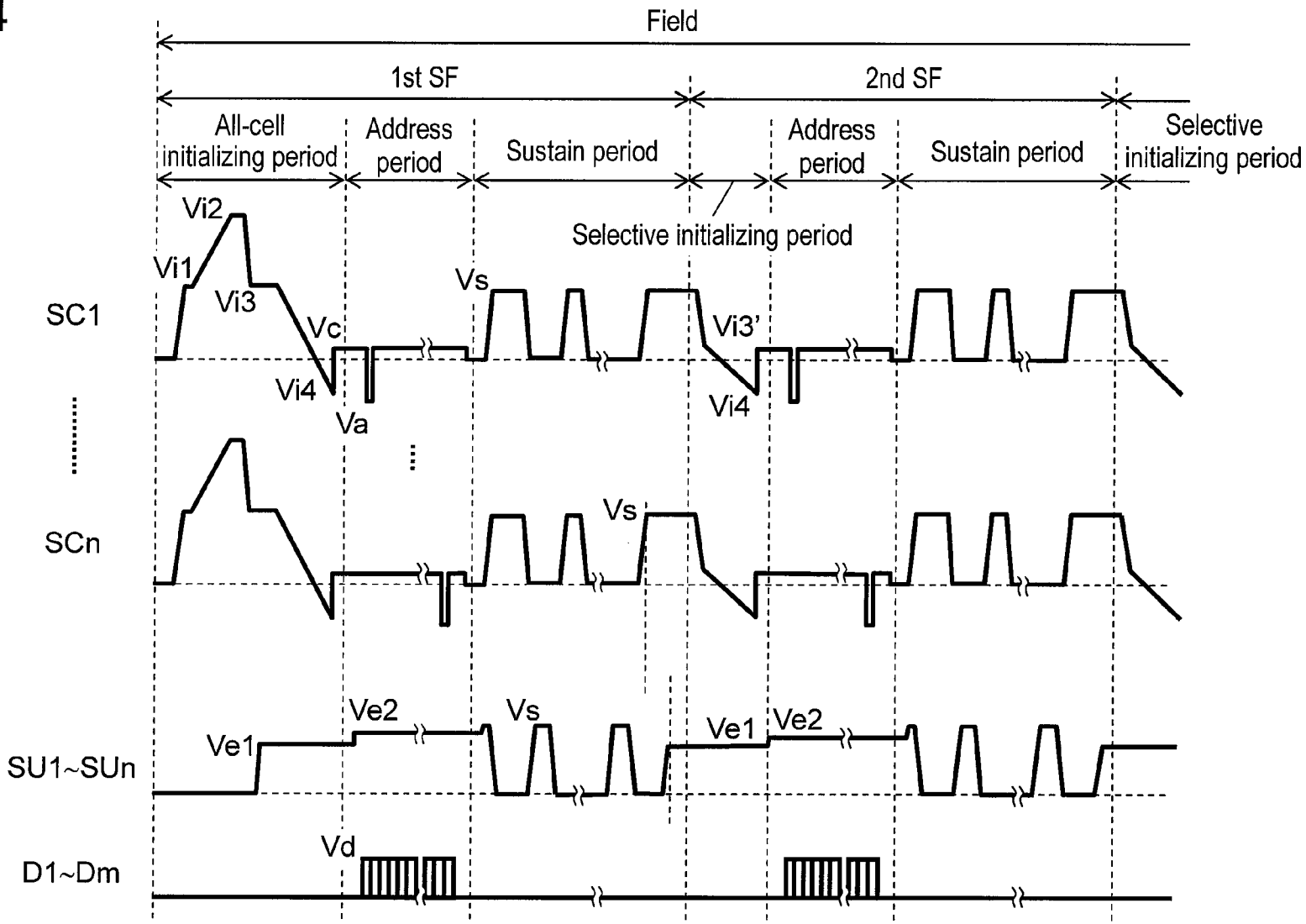
FIG. 4 is a diagram of drive voltage waveforms in the plasma display device.

FIG. 4 is a diagram of drive voltage waveforms in plasma display device 1 in accordance with the exemplary embodiment of the present invention. FIG. 4 shows drive voltage waveforms in two subfields (SFs): the first SF, i.e. a subfield in which an all-cell initializing operation is performed (hereinafter "all-cell initializing subfield"); and the second SF, i.e. a subfield in which a selective initializing operation is performed (hereinafter "selective initializing subfield"). The drive voltage waveforms in the other subfields are similar to these waveforms.

First, a description is provided of the first SF, i.e. an all-cell initializing subfield.

In the first half of the all-cell initializing period in the first SF, 0(V) is applied to data electrodes D1 to Dm and sustain electrodes SU1 to SUn. Applied to scan electrodes SC1 to SCn is a ramp waveform voltage that gently increases from voltage Vi1 of a breakdown voltage or lower to voltage Vi2 exceeding the breakdown voltage with respect to sustain electrodes SU1 to SUn (hereinafter referred to as "increasing ramp waveform voltage").

While this ramp waveform voltage is increasing, weak initializing discharge continuously occurs between scan electrodes SC1 to SCn and sustain electrodes SU1 to SUn, and between scan electrodes SC1 to SCn and data electrodes D1 to Dm, respectively. Then, negative wall voltage accumulates on scan electrodes SC1 to SCn. Positive wall voltage accumulates on data electrodes D1 to Dm and sustain electrodes SU1 to SUn. Now, the wall voltage on the electrodes shows the voltage generated by the wall charge accumulated on the dielectric layers, protective layer, phosphor layers, and the like covering the electrodes.

In the second half of the all-cell initializing period, a positive voltage of Ve1 is applied to sustain electrodes SU1 to SUn, and 0(V) is applied to data electrodes D1 to Dm. Applied to scan electrodes SC1 to SCn is a ramp waveform voltage that gently decreases from voltage Vi3 of the breakdown voltage or lower to voltage Vi4 exceeding the breakdown voltage with respect to sustain electrodes SU1 to SUn (hereinafter "decreasing ramp waveform voltage"). During this application, weak initializing discharge continuously occurs between scan electrodes SC1 to SCn and sustain electrodes SU1 to SUn, and between scan electrodes SC1 to SCn and data electrodes D1 to Dm, respectively. This weak discharge weakens the negative wall voltage on scan electrodes SC1 to SCn and the positive wall voltage on sustain electrodes SU1 to SUn, and adjusts the positive wall voltage on data electrodes D1 to Dm to a value appropriate for the address operation.

Thus, the all-cell initializing operation in which initializing discharge is performed on all the discharge cells is completed. In some of the subfields constituting one field, the initializing operation in the first half of the all-cell initializing operation may be omitted. In this case, the initializing operation is a selective initializing operation in which initializing operation is performed selectively on the discharge cells having generated sustain discharge in the preceding subfield. In this exemplary embodiment, the all-cell initializing operation having the first and second halves is performed in the first SF, and the selective initializing operation only having the second half of the all-cell initializing operation is performed in the second SF and thereafter. However, the above description simply gives an example, and the present invention is not limited to this subfield structure.

In the succeeding address period, voltage Ve2 is applied to sustain electrodes SU1 to SUn, and voltage Vc is applied to scan electrodes SC1 to SCn.

First, negative scan pulse voltage Va is applied to scan electrode SC1 in the first row, and positive address pulse voltage Vd is applied to data electrode Dk (Dk being one of data electrodes D1 to Dm to be selected according to image data) of the discharge cell to be lit in the first row among data electrodes D1 to Dm. At this time, the voltage difference at the intersection between data electrode Dk and scan electrode SC1 is the addition of the difference in externally applied voltage (Vd−Va), and the difference between the wall voltage on data electrode Dk and the wall voltage on scan electrode SC1, thus exceeding the breakdown voltage. Then, address discharge occurs between data electrode Dk and scan electrode SC1, and between sustain electrode SU1 and scan electrode SC1. Positive wall voltage accumulates on scan electrode SC1 and negative wall voltage accumulates on sustain electrode SU1. Negative wall voltage also accumulates on data electrode Dk.

In this manner, the address operation is performed to cause address discharge in the discharge cells to be lit in the first row and to accumulate wall voltage on the respective electrodes. On the other hand, the voltage at the intersections between data electrodes D1 to Dm subjected to no address pulse voltage Vd and scan electrode SC1 does not exceed the breakdown voltage, thus causing no address discharge. The above address operation is performed on the discharge cells up to the n-th row and the address period is completed.

In the succeeding sustain period, 0(V) is applied to sustain electrodes SU1 to SUn, and positive sustain pulse voltage Vs is applied to scan electrodes SC1 to SCn. Then, in the discharge cells having generated the address discharge, the voltage difference between scan electrode SCi and sustain electrode SUi amounts to the addition of sustain pulse voltage Vs and the difference between the wall voltage on scan electrode SCi and the wall voltage on sustain electrode SUi, thus exceeding the breakdown voltage. Then, sustain discharge occurs between scan electrode SCi and sustain electrode SUi, and ultraviolet light generated at this time causes phosphor layers 35 to emit light.

This discharge accumulates negative wall voltage on scan electrode SCi, and positive wall voltage on sustain electrodes SUi. Positive wall voltage also accumulates on data electrode Dk. In the discharge cells having generated no address discharge in the address period, no sustain discharge occurs and the wall voltage at the completion of the initializing period is maintained.

Successively, 0 (V) is applied to scan electrodes SC1 to SCn, and positive sustain pulse voltage Vs is applied to sustain electrodes SU1 to SUn. Then, in the discharge cell having generated the sustain discharge, the voltage difference between sustain electrode SUi and scan electrode SCi exceeds the breakdown voltage, thereby causing sustain discharge between sustain electrode SUi and scan electrode SCi again. Thus, negative wall voltage accumulates on sustain electrode SUi, and positive wall voltage on scan electrode SCi.

Similarly, the sustain pulses in a number obtained by multiplying the brightness weight by the luminance factor are applied alternately to scan electrodes SC1 to SCn and sustain electrodes SU1 to SUn to give a potential difference between the electrodes of each display electrode pair 24. Thereby, sustain discharge is continued in the discharge cells having generated address discharge in the address period.

At the end of the sustain period, a potential difference in a so-called narrow pulse form is given between scan electrodes SC1 to SCn and sustain electrodes SU1 to SUn. Thereby, while positive wall voltage is left on data electrode Dk, the wall voltage on scan electrode SCi and sustain electrode SUi is reduced. Thus, the sustain operation in the sustain period is completed.

Next, a description is provided of the operation in the second SF, i.e. a selective initializing subfield.

In the selective initializing period of the second SF, while voltage Ve1 is applied to sustain electrodes SU1 to SUn and 0(V) is applied to data electrodes D1 to Dm, a decreasing ramp waveform voltage gently decreasing from voltage Vi3' to voltage Vi4 is applied to scan electrodes SC1 to SCn.

In the discharge cells having generated sustain discharge in the sustain period of the preceding subfield, weak initializing discharge occurs, and weakens the wall voltage on scan electrode SCi and sustain electrode SUi. On data electrode Dk, sufficient positive wall voltage is accumulated by the sustain discharge generated immediately before. Thus, the excessive wall voltage is discharged and adjusted to a wall voltage appropriate for the address operation.

On the other hand, in the discharge cells having generated no sustain discharge in the preceding subfield, no discharge occurs, and the wall charge at the completion of the initializing period of the preceding subfield is maintained.

The operation in the succeeding address period is the same as the operation in the address period of the all-cell initializing subfield. Thus, the description is omitted. The operation in the succeeding sustain period is the same except for the number of sustain pulses.

In the subfield structure of this exemplary embodiment, one field is divided into 10 subfields (the first SF, and second SF to tenth SF), and the respective subfields have different brightness weights (e.g. 1, 2, 3, 6, 11, 18, 30, 44, 60, and 80). The all-cell initializing operation is performed in the initializing period of the first SF, and the selective initializing operation is performed in the initializing periods of the second to 10th SFs. However, the number of subfields and the brightness weights of the respective subfields are not limited to the above values. The subfield structure may be changed according to image signals or the like. In the sustain period of each subfield, the sustain pulses in a number obtained by multiplying the brightness weight of the subfield by a predetermined luminance factor are applied to each display electrode pair 24. This luminance factor is changed according to the state of the image, specifically according to the detection results of APL detecting circuit 56. The luminance factor is controlled by timing generating circuit 55 so that the luminance factor is larger at a lower APL and lower at a higher APL.

Figure 5:
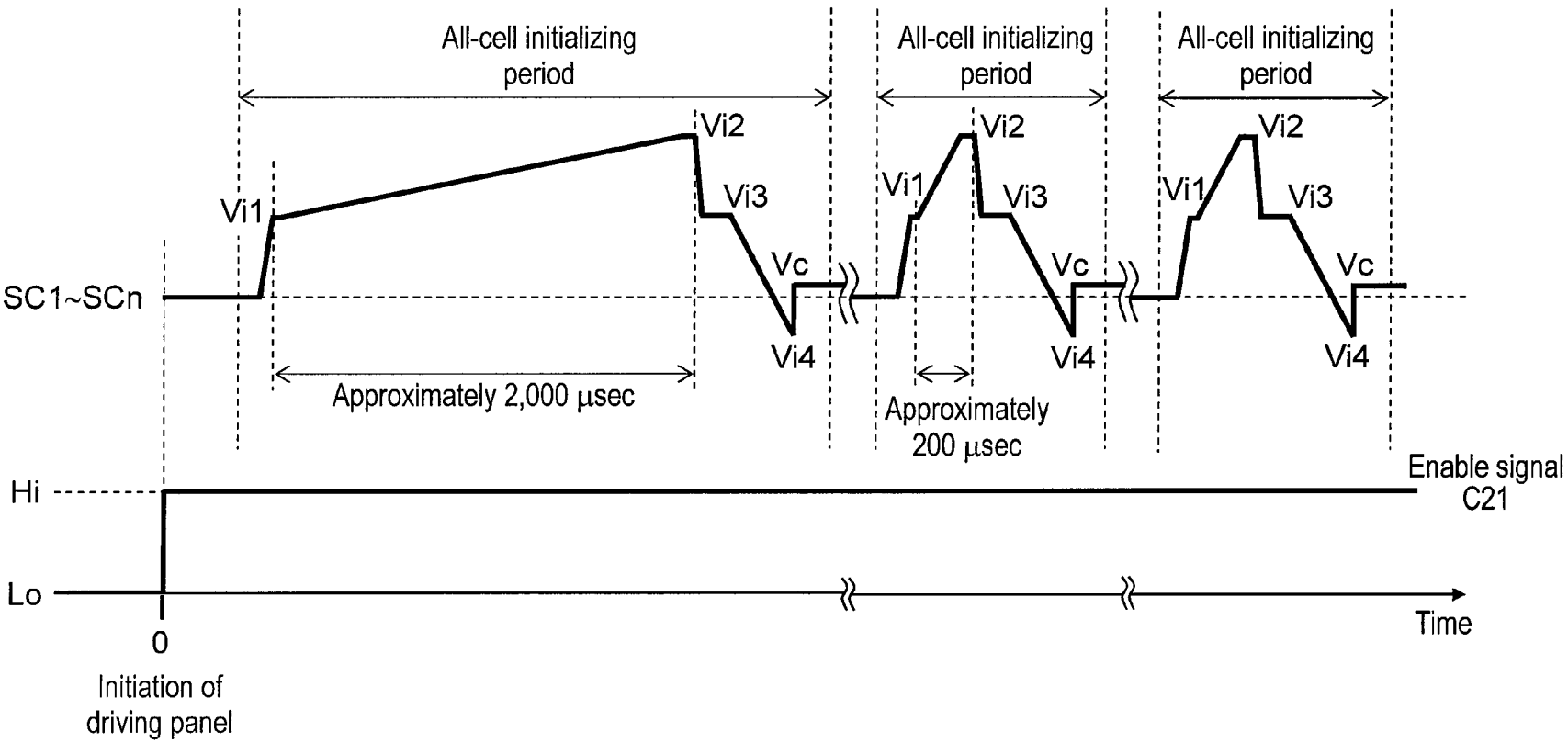
FIG. 5 is a diagram of a drive voltage waveform in an all-cell initializing period immediately after start of driving the panel in accordance with the exemplary embodiment of the present invention.

Next, a description is provided of a drive voltage waveform in the all-cell initializing period immediately after the start of driving panel 10. FIG. 5 is a diagram of a drive voltage waveform in the all-cell initializing period immediately after the start of driving panel 10 in accordance with the exemplary embodiment of the present invention. The difference of this drive voltage waveform from that of FIG. 4 is only in the slope of the increasing ramp waveform voltage applied to scan electrodes SC1 to SCn in the first half of the all-cell initializing period. The other operation is the same. For this reason, FIG. 5 only shows the drive voltage waveform to be applied to scan electrodes SC1 to SCn. Further, FIG. 5 also shows a drive voltage waveform in the all-cell initializing periods in normal operation, for comparison.

As described above, in the first half of the all-cell initializing period, 0(V) is applied to data electrodes D1 to Dm and sustain electrodes SU1 to SUn. Applied to scan electrodes SC1 to SCn is an increasing ramp waveform voltage that gently increases from voltage Vi1 of the breakdown voltage or lower to voltage Vi2 exceeding the breakdown voltage with respect to sustain electrodes SU1 to SUn. At this time, in the all-cell initializing operation to be performed for the first time after the start of driving panel 10, i.e. after plasma display device 1 is powered on, the increasing ramp waveform voltage to be applied to scan electrodes SC1 to SCn is generated so as to have a gentler slope than the increasing ramp waveform voltage in the normal all-cell initializing operations, as shown in FIG. 5. In this exemplary embodiment, such driving reduces the initializing spots generated immediately after the start of driving panel 10. The reasons therefor are as follows.

Immediately after plasma display device 1 is powered on, i.e. immediately after the device is changed from the non-operating state to the operating state, the operation of the image signal processing circuit, power supply circuit, or each driving circuit is not stable and thus an abnormal image having a display luminance and gradation value different from those of the input image signals can be displayed. To address this problem, in this exemplary embodiment, the address operation in the address period is stopped to effect image muting, and all the discharge cells are unlit to display a black picture on the entire image display surface, for a few seconds (approximately two seconds for this embodiment) immediately after plasma display device 1 is powered on until the operation of each of the circuits is stabilized.

At this time, in panel 10 immediately after the driving is initiated, insufficient priming particles are likely to increase discharge delay (time delay after the voltage applied to the discharge cells exceeds the breakdown voltage before the discharge actually occurs). In the discharge caused by application of an increasing ramp waveform voltage, the large discharge delay considerably increases the applied voltage after the breakdown voltage is exceeded before the discharge actually occurs, and thus induces strong discharge. This strong discharge can cause sustain discharge and thus light emission even without address operation, in some discharge cells. In other words, initializing spots can be generated.

Particularly in the image muting period, a black picture is displayed on the entire image display surface of panel 10, and thus initializing spots are easily recognized.

At this time, an increasing ramp waveform voltage having a gentler slope is applied. This waveform voltage can inhibit an increase in the voltage after the breakdown voltage is exceeded before actual discharge occurs, even when the discharge delay is large. Thus, the generation of strong discharge can be reduced. In other words, generation of initializing spots can be reduced.

In this exemplary embodiment, as shown in FIG. 5, in the all-cell initializing operation to be performed for the first time after plasma display device 1 is powered on and the driving of panel 10 is initiated, an increasing ramp waveform voltage is generated so as to have a gentler slope than the increasing ramp waveform voltage in the normal diving operation. Specifically, as shown in FIG. 5, in the increasing ramp waveform voltage in the normal all-cell initializing operation, voltage Vi1 is increased to voltage Vi2 for approximately 200 μsec. In contrast, in the all-cell initializing operation to be performed for the first time after plasma display device 1 is powered on, voltage Vi1 is increased to voltage Vi2 for approximately 2,000 μsec. In the latter all-cell initializing operation, the increasing ramp waveform voltage is generated so as to have a slope approximately one tenth the slope generated in the normal operation.

This operation can inhibit generation of strong discharge and reduce generation of initializing spots in the all-cell initializing operation performed with fewer priming particles immediately after the start of driving panel 10. Once the all-cell initializing discharge is caused, this discharge generates sufficient priming particles. Thus, in the all-cell initializing discharge thereafter, the increasing ramp waveform voltage can be generated so as to have a normal slope.

On the other hand, the increasing ramp waveform voltage having a gentler slope makes the all-cell initializing period longer by the gentler slope. Thus, it is possible that some subfields extend out of one field. To address this problem, in this exemplary embodiment, control is made so that the total number of sustain pulses generated in a first field after the start of driving panel 10 is equal to or smaller than the total number of sustain pulses in one field in normal operation. This control can ensure the margin of the all-cell initializing period extended by the gentler slope of the increasing ramp waveform voltage.

Specifically, in the first field after the start of driving panel 10, the luminance factor is fixed to the minimum value within a setting range regardless of the APL. As described above, for this exemplary embodiment, the luminance factor is changed according to the detection results of APL detecting circuit 56. The luminance factor is controlled in the following manner. For an image signal having a higher APL, the luminance factor is set lower. (For example, for an image having an APL of 100%, the luminance factor is 1.) For an image signal having a lower APL, the luminance factor is set higher. (For example, for an image having an APL of 50%, the luminance factor is 2. For an image having an APL up to 20%, the luminance factor is 5. The luminance factor between these values is gradually changed according to the APL.) This control can change the total number of sustain pulses in one field according to the APL, and adjust the brightness of images to be displayed.

Then, in the first field after the start of driving panel 10, the luminance factor is fixed to the minimum value within the setting range, i.e. 1, regardless of the APL. Setting the total number of sustain pulses in the above field equal to or smaller than the total number of sustain pulses in each of the other fields in this manner can ensure the temporal margin necessary for providing the increasing ramp waveform voltage having a gentler slope.

In this exemplary embodiment, the time when enable signal C21 showing the power-on is changed from the low state to the high state is determined to be the start of driving panel 10. Timing generating circuit 55 shown in FIG. 3 controls the slope of the increasing ramp waveform in the all-cell initializing operation immediately after the start of driving, and fixes the luminance factor only in one field immediately after the start of driving, according to enable signal C21 supplied from ON-OFF controller 78. However, the present invention is not limited to this structure. The circuits for such control may be provided separately.

In this exemplary embodiment, the potential difference between voltage Vi1 and voltage Vi2 is set at approximately 260 (V). The slope of the increasing ramp waveform voltage in the normal all-cell initializing operation is set at approximately 1.3 (V)/μsec. The slope of the increasing ramp waveform voltage in the all-cell initializing operation to be performed for the first time after the start of driving panel 10 is set at approximately 0.13 (V)/μsec. However, these values are only samples. It is preferable to set values optimum for the characteristics of the panel and the specifications of the plasma display device. However, in order to provide the advantage of reducing initializing spots generated immediately after the start of driving panel 10, preferably, the slope of the increasing ramp waveform voltage in the all-cell initializing operation to be performed for the first time is set equal to or smaller than approximately 0.6 (V)/μsec.

Figure 6:
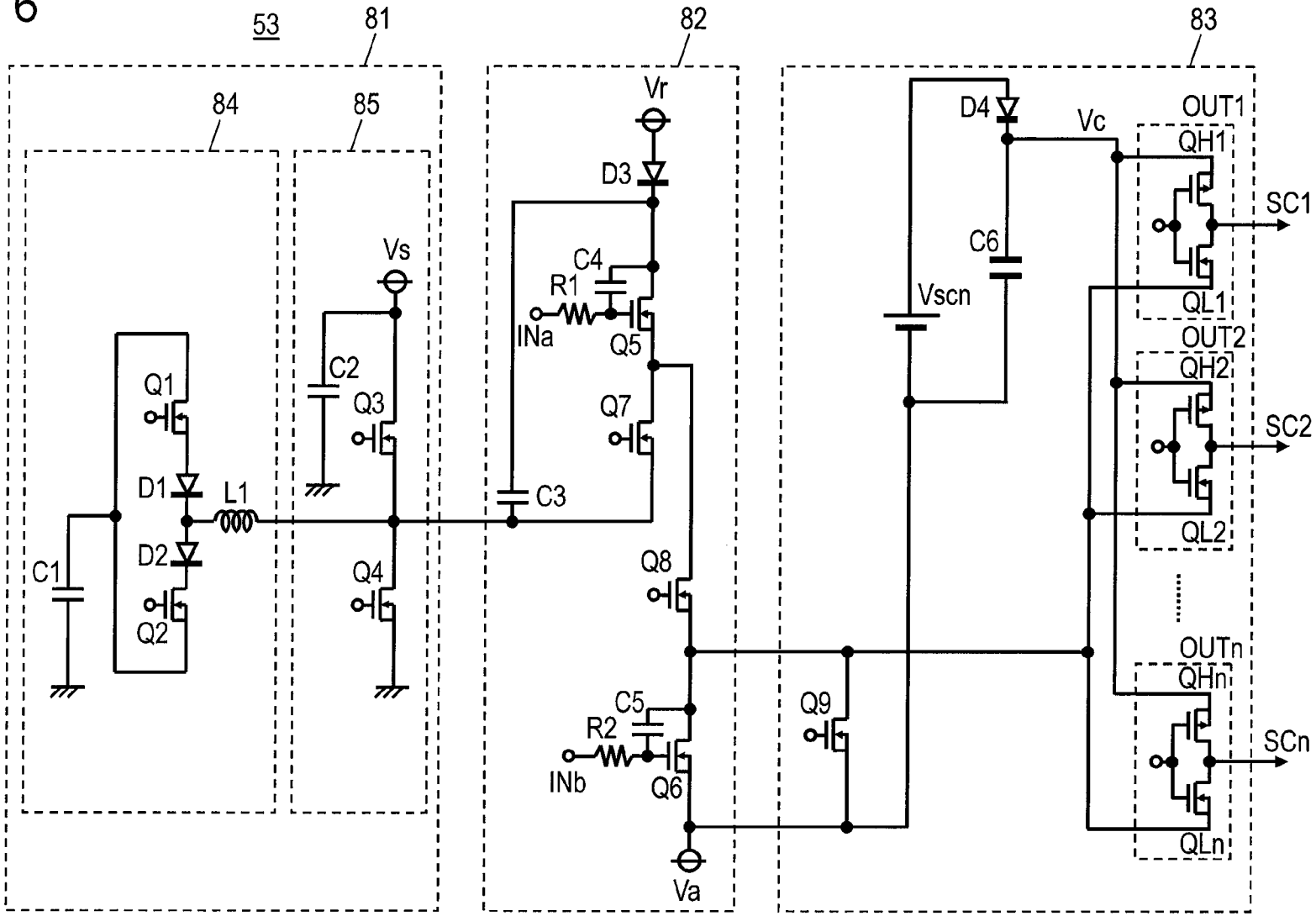
FIG. 6 is a circuit diagram of a scan electrode driving circuit in accordance with the exemplary embodiment of the present invention.

Next, a description is provided of the details and operation of scan electrode driving circuit 53. FIG. 6 is a circuit diagram of scan electrode driving circuit 53 in accordance with the exemplary embodiment of the present invention. Scan electrode driving circuit 53 includes sustain pulse generating circuit 81 for generating sustain pulses, initializing waveform generating circuit 82 for generating initializing waveforms, and scan pulse generating circuit 83 for generating scan pulses.

Sustain pulse generating circuit 81 includes power recovery circuit 84 and clamp circuit 85. Power recovery circuit 84 includes power recovery capacitor C1, switching element Q1, switching element Q2, blocking diode D1, blocking diode D2, and resonance inductor L1. Power recovery capacitor C1 has a capacitance sufficiently larger than inter-electrode capacitance Cp and is charged to approximately Vs/2, i.e. half of voltage Vs, to work as a power supply of power recovery circuit 84. Clamp circuit 85 includes switching element Q3 for clamping scan electrodes SC1 to SCn to voltage Vs, and switching element Q4 for clamping scan electrodes SC1 to SCn to 0 (V). Further, the clamp circuit includes smoothing capacitor C2 for reducing the impedance of voltage source Vs. Then, the sustain pulse generating circuit generates sustain pulse voltage Vs according to the timing signals supplied from timing generating circuit 55.

Initializing waveform generating circuit 82 includes the following elements: a Miller integrator that includes switching element Q5, capacitor C4, and resistor R1 and generates an increasing ramp waveform voltage gently increasing to predetermined initializing voltage Vi2 in a ramp form; and a Miller integrator that includes switching element Q6, capacitor C5, and resistor R2 and generates a decreasing ramp waveform voltage gently decreasing to voltage Vi4 in a ramp form; a separating circuit using switching element Q7; and a separating circuit using switching element Q8. According to the timing signals supplied from timing generating circuit 55, the initializing waveform generating circuit generates the above initializing waveforms and controls initializing voltage Vi2 in the all-cell initializing operation. FIG. 6 shows the input terminals of the respective Miller integrators as input terminal INa and input terminal INb.

Scan pulse generating circuit 83 includes the following elements: switching circuits OUT1 to OUTn for outputting scan pulse voltage to scan electrodes SC1 to SCn, respectively; switching element Q9 for clamping the low voltage sides of switching circuits OUT1 to OUTn to voltage Va; and diode D4 and capacitor C6 for applying voltage Vc, i.e. voltage Va and voltage Vscn superimposed thereto, to the high voltage sides of switching circuits OUT1 to OUTn. Switching circuits OUT1 to OUTn include switching elements QH1 to QHn for outputting voltage Vc, and switching elements QL1 to QLn for outputting voltage Va, respectively. Then, according to the timing signals supplied from timing generating circuit 55, the scan pulse generating circuit sequentially generates scan pulse voltage Va to be applied to scan electrodes SC1 to SCn in the address period.

Because switching element Q3, switching element Q4, switching element Q7, and switching element Q8 carry an extremely large current, a plurality of FETs, IGBTs or the like are parallel-connected to these switching elements to reduce the impedance thereof.

In this exemplary embodiment, a FET-including Miller integrator that is practical and has a relatively simple structure is used for initializing waveform generating circuit 82. However, the present invention is not limited to this structure. Any circuit may be used as long as the circuit is capable of generating an increasing ramp waveform voltage and a decreasing ramp waveform voltage.

Though not shown, the sustain pulse generating circuit of sustain electrode driving circuit 54 has the same structure as sustain pulse generating circuit 81. The sustain pulse generating circuit of the sustain electrode driving circuit includes the following elements: a power recovery circuit for recovering and reusing the power for driving sustain electrodes SU1 to SUn; a switching element for clamping sustain electrodes SU1 to SUn to voltage Vs; and a switching element for clamping sustain electrodes SU1 to SUn to 0 (V). This sustain pulse generating circuit generates sustain pulse voltage Vs according to the timing signals supplied from timing generating circuit 55.

Next, a description is provided of the operation of initializing waveform generating circuit 82 and the method of controlling the slope of the increasing ramp waveform voltage, with reference to the accompanying drawings. First, a description is provided of the operation of generating an initializing waveform voltage in the normal all-cell initializing operation, with reference to FIG. 7. Next, a description is provided of the operation of generating an initializing waveform voltage in the all-cell initializing operation immediately after the start of driving panel 10 (the all-cell initializing operation in which the slope of the increasing ramp waveform voltage is gentler), with reference to FIG. 8. The operation other than the generation of the increasing ramp waveform voltage is the same in FIG. 7 and FIG. 8. Thus, with reference to FIG. 8, only the generation of the increasing ramp waveform voltage is described.

Figure 7:
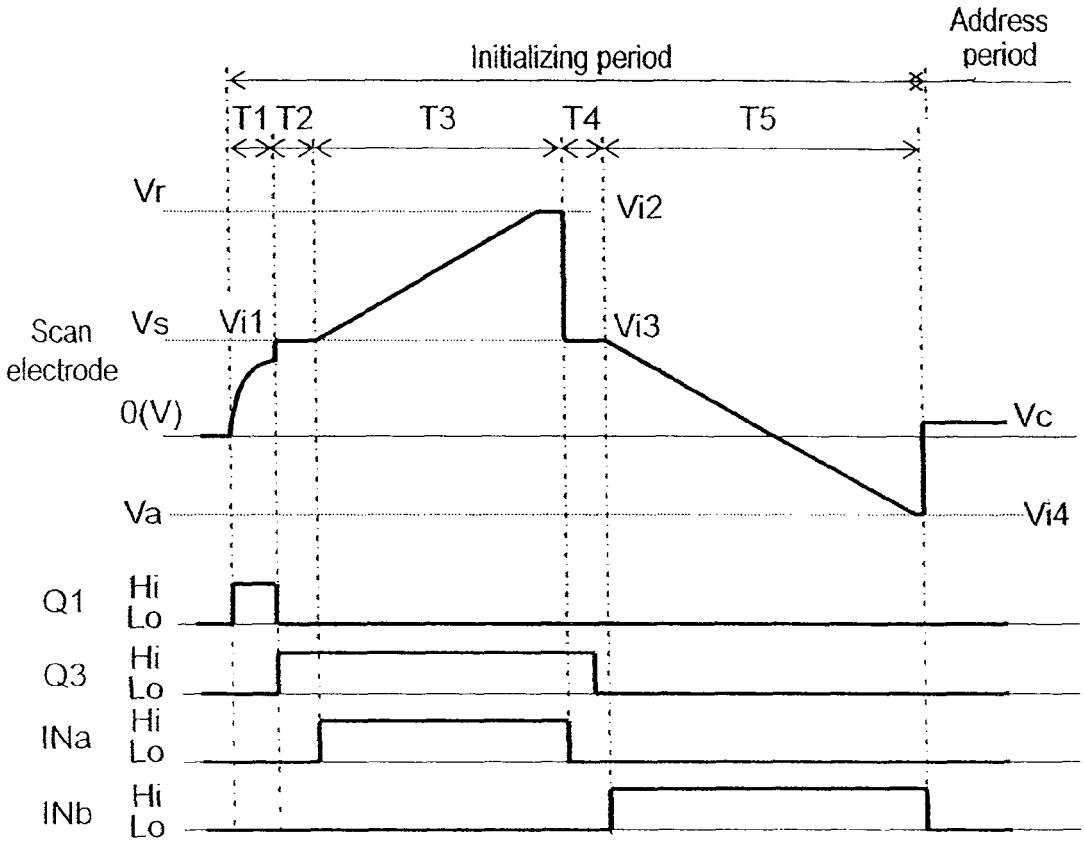
FIG. 7 is a timing diagram for explaining the operation of the scan electrode driving circuit in an all-cell initializing period in normal operation in accordance with the exemplary embodiment of the present invention.
Figure 8:
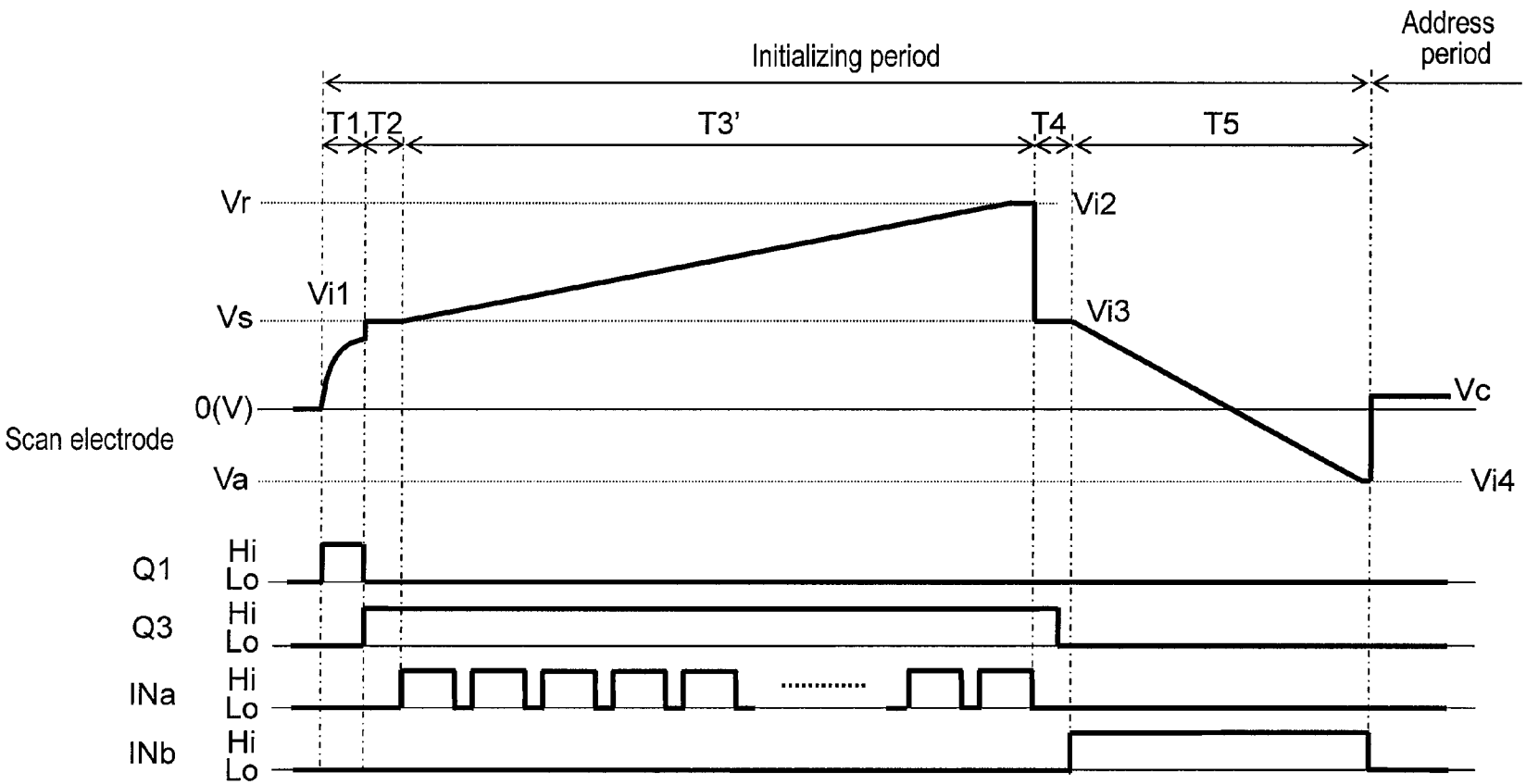
FIG. 8 is a timing diagram for explaining the operation of the scan electrode driving circuit in the all-cell initializing period immediately after the start of driving the panel in accordance with the exemplary embodiment of the present invention.

In FIG. 7 and FIG. 8, each of the drive voltage waveforms for performing the all-cell initializing operation is divided into five sub-periods shown by sub-period T1 to sub-period T5, and a description is provided of each sub-period. In the description, voltage Vi1 and voltage Vi3 are equal to voltage Vs, voltage Vi2 is equal to voltage Vr, and voltage Vi4 is equal to negative voltage Va. In the following description, the operation of bringing a switching element into conduction is indicated as "turn on", and the operation of ceasing conduction is indicated as "turn off". In the drawings, a signal for turning on the switching element is indicated as "Hi", and a signal for turning off is indicated as "Lo".

FIG. 7 is a timing diagram for explaining the operation of scan electrode driving circuit 53 in the all-cell initializing period in normal operation in accordance with the exemplary embodiment of the present invention. The drive voltage waveform supplied from initializing waveform generating circuit 82 is to be supplied from scan pulse generating circuit 83 without any change.

(Sub-period T1)

First, switching element Q1 in sustain pulse generating circuit 81 is turned on. Then, a resonance occurs between inter-electrode capacitance Cp and inductor L1. Thus, current flows from capacitor C1 through switching element Q1, diode D1, and inductor L1, and starts to increase the voltage of scan electrodes SC1 to SCn.

(Sub-period T2)

Next, switching element Q3 in sustain pulse generating circuit 81 is turned on. Then, voltage Vs is applied to scan electrodes SC1 to SCn through switching element Q3. This operation makes the potential of scan electrodes SC1 to SCn equal to voltage Vs (equal to voltage Vi1 in this exemplary embodiment).

(Sub-period T3)

Next, input terminal INa of the Miller integrator for generating an increasing ramp waveform voltage is set at "Hi". Specifically, a voltage of 15 (V), for example, is applied to input terminal INa. Thus, a constant current flows from resistor R1 toward capacitor C4. This current increases the source voltage of switching element Q5 in a ramp form and also increases the output voltage of scan electrode driving circuit 53 in a ramp form.

Then, input terminal INa is kept at "Hi", until this output voltage increases to reach voltage Vi2. In this manner, an increasing ramp waveform voltage that gently increases from voltage Vs equal to or lower than the breakdown voltage (equal to Vi1 in this exemplary embodiment) to voltage Vi2 exceeding the breakdown voltage is generated and applied to scan electrodes SC1 to SCn.

(Sub-period T4)

After the output voltage reaches voltage Vi2, input terminal INa is set at "Lo". Specifically, a voltage of 0 (V), for example, is applied to input terminal INa. Then the voltage of scan electrodes SC1 to SCn is decreased to voltage Vs (equal to Vi3 in this exemplary embodiment).

After the voltage of scan electrodes SC1 to SCn is decreased to voltage Vs, switching element Q3 is turned off.

(Sub-period T5)

Next, input terminal INb of the Miller integrator for generating a decreasing ramp waveform voltage is set at "Hi". Specifically, a voltage of 15 (V), for example, is applied to input terminal INb. Thus, a constant current flows from resistor R2 toward capacitor C5. This current decreases the drain voltage of switching element Q6 in a ramp form and also decreases the output voltage of scan electrode driving circuit 53 in a ramp form. After the output voltage reaches predetermined negative voltage Vi4, input terminal INb is set at "Lo". Specifically, a voltage of 0 (V), for example, is applied to input terminal INb.

In the above manner, scan electrode driving circuit 53 applies, to scan electrodes SC1 to SCn, an increasing ramp waveform voltage that gently increases from voltage Vi1 equal to or lower than the breakdown voltage to initializing voltage Vi2 exceeding the breakdown voltage, and thereafter a decreasing ramp waveform voltage that gently decreases from voltage Vi3 to voltage Vi4.

Next, with reference to FIG. 8, a description is provided of the operation of generating an increasing ramp waveform voltage having a gentler slope. FIG. 8 is a timing diagram for explaining the operation of scan electrode driving circuit 53 in the all-cell initializing period immediately after the start of driving panel 10 in accordance with the exemplary embodiment of the present invention. In FIG. 8, the operations in sub-period T1, sub-period T2, sub-period T4, and sub-period T5 are the same as those in sub-period T1, sub-period T2, sub-period T4, and sub-period T5 of FIG. 7. Thus, a description is provided only of the operation in sub-period T3', which is different from the operation in sub-period T3 of FIG. 7.

(Sub-period T3')

In sub-period T3', input terminal INa of the Miller integrator for generating the increasing ramp waveform voltage is set at "Hi". Thus, a constant current flows from resistor R1 toward capacitor C4. This current increases the source voltage of switching element Q5 in a ramp form and also increases the output voltage of scan electrode driving circuit 53 in a ramp form.

In this exemplary embodiment, after input terminal INa is kept at "Hi" for a predetermined period, input terminal INa is kept at "Lo" for a predetermined period. This operation stops an increase in the output voltage of scan electrode driving circuit 53 once. Thereafter, input terminal INa is set at "Hi" again, to restart the increase in the output voltage of scan electrode driving circuit 53. Then, a series of these operations, i.e. setting input terminal INa at "Hi" to increase the output voltage of scan electrode driving circuit 53 and setting input terminal INa at "Lo" to stop the increase in the output voltage once, are repeated at predetermined time intervals.

Specifically, the operation of keeping input terminal INa at "Hi" for a period of approximately 5,500 nsec and then keeping input terminal INa at "Lo" for a period of approximately 50 nsec is repeated during sub-period T3' (of approximately 2,000 μsec in this exemplary embodiment). In this exemplary embodiment, such control can alternately increase and stop the output voltage of scan electrode driving circuit 53, thus providing a gentler slope of the increasing ramp waveform voltage.

As described above, in this exemplary embodiment, scan electrode driving circuit 53 has the circuit structure of FIG. 6 and the period during which input terminal INa of the Miller integrator for generating the increasing ramp waveform voltage is kept at "Hi" is controlled as shown in FIG. 7 and FIG. 8. With this structure and control, the slope of the gently increasing ramp waveform voltage can be controlled easily.

Various methods other than described herein can be considered to change the slope of the increasing ramp waveform voltage. For example, the resistance of resistor R1 connected to input terminal INa of the Miller integrator for generating an increasing ramp waveform voltage can be set changeable and the slope of the increasing ramp waveform voltage can be switched by changing the resistance. In this exemplary embodiment, the method of changing the slope of the increasing ramp waveform voltage is not limited to the above-described methods, and any other method can be used.

In the description of this exemplary embodiment, the period during which input terminal INa of the Miller integrator is kept at "Hi" is approximately 5,500 nsec, and the period during which the input terminal is kept at "Lo" is approximately 50 nsec, when the increasing ramp waveform voltage is generated in the all-cell initializing period immediately after the start of panel 10. However, these values are only examples set according to the characteristics of a panel that has 768 display electrode pairs and a 42-inch diagonal screen. This exemplary embodiment is not limited to these values. Preferably, the above values are set optimum for the characteristics of the panel and the specifications of the plasma display device.

In the description of this exemplary embodiment, the increasing ramp waveform voltage to be applied to scan electrodes SC1 to SCn for the first time after the start of driving panel 10 is generated so as to have a gentler slope than the other increasing ramp waveform voltages. However, the slope need not be kept constant necessarily throughout the period during which the increasing ramp waveform voltage is applied. The increasing ramp waveform voltage to be applied to scan electrodes SC1 to SCn for the first time after the start of driving panel 10 may be generated in the following manner. The period during which this increasing ramp waveform voltage is applied is set longer than each of the periods during which the other ramp waveform voltages are applied. At this time, the slope of this increasing ramp waveform voltage starts at a start voltage (Vi1) and ends at an end voltage (Vi2), and these start voltage and end voltage are set equal to those of the slopes of the other ramp waveform voltages. For example, the increasing ramp waveform voltage to be applied to scan electrodes SC1 to SCn for the first time after the start of driving panel 10 may include the following two kinds of sub-periods: a sub-period during which a voltage is applied so as to have a slope equal to the slopes of the other increasing ramp waveform voltages; and a sub-period during which the applied voltage is substantially unchanged. Repeating these sub-periods can set the application period of the increasing ramp waveform voltage to be generated for the first time longer than the application period of the other increasing ramp waveform voltages while the start voltage (Vi1) and end voltage (Vi2) of the slope are equal to those of the slopes the other increasing ramp waveform voltages. Such a structure can also offer the same advantages as the case where the increasing ramp waveform voltage is generated so as to have a gentler slope.

As described above, in this exemplary embodiment, in the all-cell initializing operation to be performed for the first time after plasma display device 1 is powered on, an increasing ramp waveform voltage is generated so as to have a gentler slope than the increasing ramp waveform voltage in normal driving operation. This operation can reduce the initializing spots generated immediately after the start of driving the panel and improve the quality of images to be displayed.

In this exemplary embodiment, the point of time when enable signal C21 showing the power-on is changed from the low state to the high state is determined to be the time of the start of driving panel 10. At this time, timing generating circuit 55 makes control so that the driving operation to be performed on panel 10 for the first time is an all-cell initializing operation.

In the description of this exemplary embodiment, image muting is effected for approximately two seconds after plasma display device 1 is powered on. However, it is preferable to set a value optimum for the characteristics of the panel and the specifications of the plasma display device.

In the description of this exemplary embodiment, the luminance factor is fixed to the minimum value (1 in the above description) within a setting range, in one field immediately after the start of driving panel 10. However, the present invention is not limited to this structure. For example, the number of sustain pulses in each subfield may be set equal to or smaller than the predetermined number of pulses (e.g. 10 or smaller), regardless of the luminance factor.

When a black picture is displayed on the entire image display surface in normal driving operation, the panel is driven by a considerably smaller number of sustain pulses than those used for displaying normal images, in each subfield. In such a case, the number of sustain pulses in one field immediately after the start of driving panel 10 can be set equal to the smaller number of sustain pulses.

Alternatively, the number of subfields in one field immediately after the start of driving panel 10 may be set smaller than the number of subfields in normal driving operation to ensure the temporal margin necessary for making the slope of the increasing ramp waveform voltage gentler. Preferably, these structures are set optimum for the characteristics of the panel and the specifications of the plasma display device.

In the description of this exemplary embodiment, the first SF is an all-cell initializing subfield. However, a subfield other than the first SF may be the all-cell initializing subfield. Also in this case, the same advantages as described above can be offered by generating an increasing ramp waveform voltage in the all-cell initializing operation to be performed for the first time after the start of driving the panel so that the increasing ramp waveform voltage has a gentler slope than the other increasing ramp waveform voltages. The present invention is not limited to the structure in which one field includes only one all-cell initializing subfield. A plurality of all-cell initializing subfields may be provided in one field. Also in this case, the same advantages as described above can be offered by generating an increasing ramp waveform voltage in the all-cell initializing operation to be performed for the first time after the start of driving the panel so that the increasing ramp waveform voltage has a gentler slope than the other increasing ramp waveform voltages.

Each of the specific values used in this exemplary embodiment is simply an example. It is preferable to set values optimum for the characteristics of the panel and the specifications of the plasma display device.

INDUSTRIAL APPLICABILITY

The present invention can reduce initializing spots generated immediately after the start of driving a panel and improve the quality of images to be displayed. Thus, the present invention is useful as a panel driving method and a plasma display device.

The invention claimed is:

1. A plasma display panel driving method, in which the plasma display panel includes a plurality of discharge cells, each of the discharge cells includes a display electrode pair and a data electrode, and the display electrode pair includes a scan electrode and a sustain electrode, the plasma display panel driving method including a plurality of fields, each field having a plurality of subfields, and at least one of the subfields having an initializing period, an address period, and a sustain period for applying voltage to the scan electrodes, the method comprising:

applying a ramp waveform voltage in a first initializing period of a field in response to the plasma display panel being powered on; and applying other ramp waveform voltages in any initializing periods of other fields subsequent to the field, wherein the ramp waveform voltage has a slope that is less than a slope of the other ramp waveform voltages.

2. The plasma display panel driving method of claim 1, wherein a total number of sustain pulses in a first field after the start of driving the plasma display panel is equal to or smaller than the total number of the sustain pulses in one of the other fields.

3. The plasma display panel driving method of claim 2, wherein the sustain pulses in a number obtained by multiplying a luminance factor variable with a state of an image by a brightness weight predetermined for each subfield are applied alternately to the display electrode pairs in the sustain period, and the luminance factor is fixed to a minimum value within a setting range regardless of the state of the image, in the first field after the start of driving the plasma display panel.

4. The plasma display panel driving method of claim 1, wherein the slope of the ramp waveform voltage to be applied to the scan electrodes for the first time after the start of driving the plasma display panel is equal to or smaller than 0.6 V/μsec.

5. The plasma display panel driving method of claim 1, wherein the ramp waveform voltage to be applied to the scan electrodes for the first time after the start of driving the plasma display panel is generated so that a period during which the ramp waveform voltage is applied is longer than periods during which the other ramp waveform voltages are applied while a start voltage and an end voltage of the slope are equal to those of the slopes of the other ramp waveform voltages.

6. A plasma display device comprising:

a plasma display panel including:

a plurality of discharge cells, each of the discharge cells including a display electrode pair and a data electrode, the display electrode pair including a scan electrode and a sustain electrode; and wherein a plurality of subfields are provided in one field so that at least one of the subfields includes an initializing period, an address period, and a sustain period, and a scan electrode driving circuit is formed so that a slope of the ramp waveform voltage is changeable, wherein the scan electrode driving circuit applies a ramp waveform voltage in a first initializing period of a field in response to the plasma display panel being powered on; and applies other ramp waveform voltages in any initializing periods of other fields subsequent to the field, wherein the ramp waveform voltage has a slope that is less than a slope of the other ramp waveform voltages.

7. The plasma display device of claim 6, further comprising:

a sustain pulse generating circuit for generating sustain pulses in a number obtained by multiplying a luminance factor variable with a state of an image by a brightness weight predetermined for each subfield, and applying the sustain pulses alternately to the display electrode pairs, wherein the sustain pulse generating circuit generates the sustain pulses so that a total number of the sustain pulses in a first field after the start of the plasma display panel is equal to or smaller than the total number of the sustain pulses in one of the other fields.

8. The plasma display device of claim 7, wherein the sustain pulse generating circuit generates the sustain pulses in the first field after the start of driving the plasma display panel so that the luminance factor is fixed to a minimum value within a setting range regardless of the state of the image.

9. The plasma display device of claim 6, wherein the scan electrode driving circuit generates the ramp waveform voltage to be applied to the scan electrodes for the first time after the start of driving the plasma display panel so that the slope of the ramp waveform voltage is equal to or smaller than 0.6 V/μsec.

10. The plasma display device of claim 6, wherein the scan electrode driving circuit generates the ramp waveform voltage to be applied to the scan electrodes for the first time after the start of driving the plasma display panel so that a period during which the ramp waveform voltage is applied is longer than periods during which the other ramp waveform voltages are applied while a start voltage and an end voltage of the slope are equal to those of the slopes the other ramp waveform voltages.

* * * * *